United States Patent [19]

Teiling

[11] 4,017,716

[45] Apr. 12, 1977

[54] METHOD AND APPARATUS FOR DIRECTING AN OBSERVATION MEMBER

[75] Inventor: Carl Torbern Teiling, Lidingo, Sweden

[73] Assignee: AGA Aktiebolag, Lidingo, Sweden

[22] Filed: Jan. 27, 1976

[21] Appl. No.: 652,885

[52] U.S. Cl. ..... 235/061.5 S; 89/41 EA; 235/61.5 E

[51] Int. Cl.[2] ..... G06G 7/80

[58] Field of Search ..... 235/61.5 R, 61.5 S, 235/61.5 E; 89/41 EA

[56] References Cited

UNITED STATES PATENTS

| | | | |
|---|---|---|---|
| 2,972,095 | 2/1961 | McDaniel et al. | 235/61.5 S |
| 3,766,826 | 10/1973 | Salomonsson | 235/61.5 E |
| 3,798,420 | 3/1974 | Kaaz | 235/61.5 S |

FOREIGN PATENTS OR APPLICATIONS

| | | | |
|---|---|---|---|
| 253,241 | 3/1967 | Austria | 235/61.5 S |
| 1,175,120 | 7/1964 | Germany | 235/61.5 S |

*Primary Examiner*—Felix D. Gruber
*Attorney, Agent, or Firm*—Lerner, David, Littenberg & Samuel

[57] ABSTRACT

Two systems are disclosed in which a pointer is directed towards a moving target over a predetermined time interval. Angular information is derived from the pointer during this time interval to generate signals indicative of the distance of the object from the pointer. During a second time interval, the pointer is automatically directed towards the moving object by use of the information derived during the first time interval.

10 Claims, 4 Drawing Figures

FIG. 1
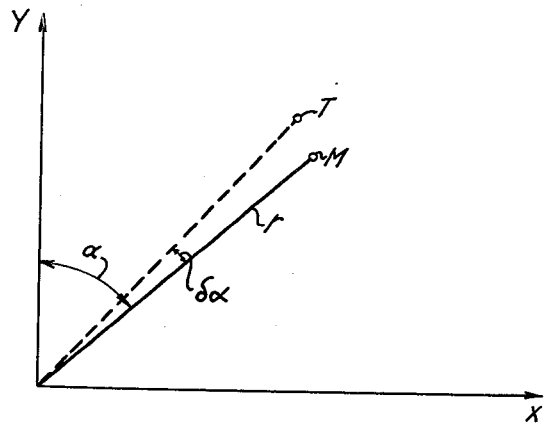
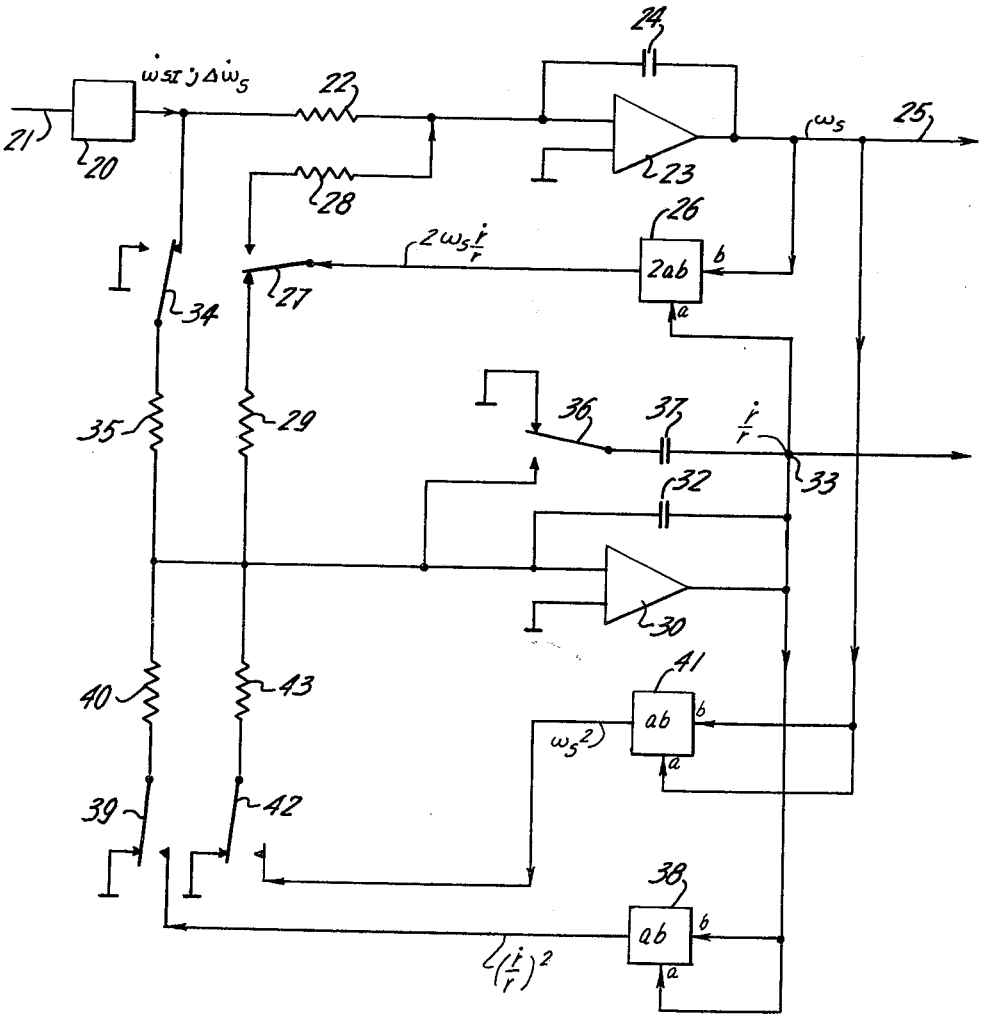
FIG. 3

METHOD AND APPARATUS FOR DIRECTING AN OBSERVATION MEMBER

FIELD OF THE INVENTION

The present invention relates to a method for directing an observation member such as a sight, a tracking telescope, a camera, a radar, an IR or laser equipment towards a moving object having a substantially constant speed in relation to the observation member.

BACKGROUND OF THE INVENTION

It is often desired to keep an observation member directed towards an object in motion, for instance a telescope towards an airplane. Even if the object in question is moving with a constant speed, the control signal necessary for keeping the member directed towards the object is very complicated. This is especially true when the object is close to the observation member. This causes great difficulties in tracking even when the control member is controlled manually by an operator.

It is known that manual control can be aided in tracking an object moving at a non-uniform speed by a control signal for constant speed tracking since the constant speed terms are still dominant.

A plurality of devices for generating such control assistance to manual tracking have been described before. All of them use, in one way or another, the equations indicating that the measuring point defined by the target observing member is moving at a substantially constant vector speed.

An example of a known solution utilizes the fact that the right-angled components of a constant vector speed in a non-rotating coordinate system also are constant is evident from, for instance, Swedish patent 158,659.

Another known solution utilizes the fact that if the component of the vector acceleration perpendicular to the radius from the observation point to the target is zero, then the law of Kepler says that the product of the distance squared and the angular velocity is constant. An example of this solution is shown in Swedish patent 336,748.

In all of the above cases, target tracking members are employed which must measure the distance from the member to the moving object.

A great many applications exist where control aid is wanted, in a situation where it is not practical to measure the distance at all or, at any rate, not continuously. This same problem exists in fire control systems so that the solution set forth herein is applicable thereto.

BRIEF DESCRIPTION OF THE INVENTION

To over come the above problem, the present invention contemplates a method of generating a drive signal for application to a drive member to assist in keeping said driven member pointed towards an object moving relative thereto. The method comprises the steps of manually pointing a member towards the object for a first time interval, generating an orientation signal which is a time function of the orientation of said member, operating upon said orientation signal to derive a further signal indicative of the movement of said object, and combining said orientation signal and said further signal at the end of said first time interval to provide the drive signal.

In the preferred embodiment of this invention, the orientation signal represents the first derivative of the angular velocity of the member and the further signal is a time function of the distance of the object from said member.

In accordance with a further embodiment of this invention, the member is the driven member.

DESCRIPTION OF THE DRAWINGS

The method according to the invention is described in more detail with reference to the accompanying drawing in which:

FIG. 1 shows a diagram for the definition of certain magnitudes:

FIGS. 3 and 4 show two different circuits which may be used in carrying out the method according to the invention.

DETAILED DESCRIPTION OF THE INVENTION

Figure 2:
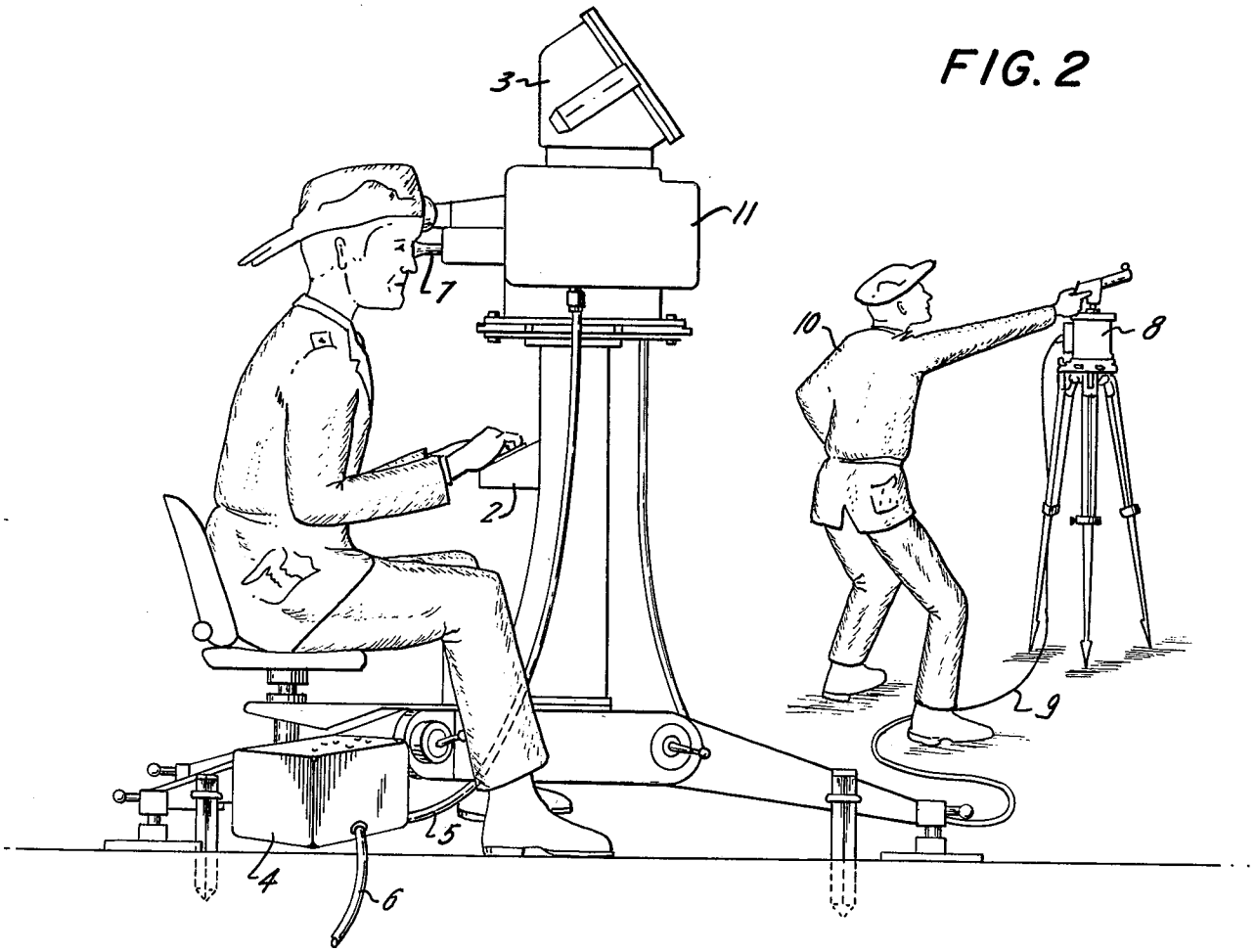
FIG. 2 shows an arrangement for carrying out the method according to the invention.

Referring now to FIG. 1, we see a diagram which is helpful in defining terms employed in connection with the description of the present invention. FIG. 1 shows a pair of coordinate axes $x$ and $y$ which define a plane. The letter M designates the defined measuring point while the letter T designates the target or object to be tracked. The distance from the origin of the coordinate system to the measuring point M is designated $r$. The azimuth angle between the line $r$ and the $y$ axis is designated $\alpha$ while the angle between the line r and the line between the target T and the origin is designated $\delta\alpha$.

The following equations describe the motion of the measuring point M as an operator of an instrument at the origin of the coordinate axis attempts to track the target T.

The vector acceleration of the measuring point M in the direction $r$ is obtained in known manner $$Ar = \ddot{r} - r\,\omega_s^2$$

where $\ddot{r}$ is the second derivative as to time of the distance $r$ and $\omega_s$ is the first derivative of the angle $\alpha$. Further, the vector acceleration of the measuring point M is obtained perpendicular to the direction of the line $r$ $$a_\alpha = r\dot{\omega}_s + 2\,\dot{r}\,\omega_s$$

where $\dot{r}$ is the time derivative of the line $r$ and $\omega_s$ is the second derivative of the angle $\alpha$.

From the above, a control equation for control of a device pointing toward the measuring point to bring it to a position pointing at the target, can be written as follows $$r\,\dot{\omega}_s + 2\,\dot{r}\omega_s = \dot{H}\,\alpha\,.\,r$$

In this equation $\dot{H}\,\alpha$ is the control signal necessary to drive the object being pointed from the measuring point M to the target T.

To obtain the dimensionless control quantity the equation can be divided by $r$ to provide:

$$\dot{H}\alpha = \dot{\omega}_s + 2\,\omega_s\,(\dot{r}/r) \qquad 1.$$

From equation 1 we can see that if a target is moving at a constant speed vector and a pointer is made to follow the same while the values $r$ and $\dot{r}$ are measured and fed into the system, the pointer need not activate the control member to change its signal in order for the measuring point to remain on the target.

However, in the situation which will be described here, no distance measuring is done and therefore the values $r$ and $\dot{r}$ are not measured. Thus, during initial tracking the pointer operates the control member manually and therefore the control function is described by the following equation:

$$\dot{H}\ \alpha = \dot{\omega}_s \qquad 2.$$

By means of the control signal and electronic arrangements which will be described in connection with the following figures $\omega_s$ and $\dot{\omega}_s$ are known, and therefore the following equation can be derived from the equation (1), provided that the vector speed of the target is constant $$\dot{r}/r = -\tfrac{1}{2} \cdot (\dot{\omega}_s/\omega_s) \qquad 3.$$

If now the expression for the acceleration component in the direction of $r$ is considered $$A_r = \ddot{r} - r\,\omega_s^2$$

it can be rewritten as $$a_r = r\left[\frac{d}{dt}\left(\frac{\dot{r}}{r}\right) + \frac{\dot{r}^2}{r^2} - \omega_s^2\right]$$

This equation may be written as $$A_r = r \cdot E_r$$

where $$\epsilon_r = \frac{\ddot{r}}{r} + \left(\frac{\dot{r}}{r}\right)^2 - \omega_s^2 . \qquad (4)$$

It is still assumed that the target motion has a constant speed vector or that it may be considered constant so that one can then put $E_r = 0$ whereafter the equation (4) is integratable if $\omega_s$ is measured. According to the invention equation (4) is now integrated to obtain $$\frac{\dot{r}}{r} - \frac{\dot{r}}{r}(o) + \int_o^t \left[\left(\frac{\dot{r}}{r}\right)^2 - \omega_s^2\right] dt = 0 \qquad (5)$$

$(\dot{r}/r)$ (0) is defined from the equation (3) at the time $t = 0$ i.e. where the integration is introduced according to what will be described in connection with the following figures and this can accordingly be used in the equation (5). From this equation is then obtained $(\dot{r}/r)$ $(t)$, which value from the time $t = 0$ in its turn may be used for control aid in azimuth direction.

In case the velocity of the target is constant one can thus theoretically get a complete control aid and simultaneously obtain information of the relative distance velocity $\dot{r}/r$ of the target. Hereby not only the value $\omega_s$ but also the value $\dot{r}/r$ can be supplied to a fire control calculator connected to the system.

In FIG. 2 an arrangement is shown for carrying out the method according to the invention. An operator 1 controls by means of a control member 2 an observation member 3, such as a panoramic sight, to be directed against a moving object. The control signal from the member 2 is fed to an electronic unit 4, which among other things contains the circuits necessary for the calculations, which are together called recontrol unit. The control signal from the member 2 to the recontrol unit 4 expresses the angular acceleration of the object in azimuth and in elevation ($\dot{\omega}_s$ and $\dot{\omega}_h$, respectively) since, different to what was described in connection with FIG. 1, one now works in three dimensions.

From the recontrol unit 4 a signal is fed through the cable 5 to the observation member, in which there is a servo system in the units 3 and 11 for directing the observation member 3 against the object. The signal in the cable 5 expresses the angular velocity of the object in azimuth and in elevation ($\omega_s$ and $\omega_h$, respectively).

Through a cable 6 data is fed indicating the angles, angular velocity and comparative distance speed of the object to a fire control calculator controlling a gun. This calculator may also be included in the unit 4, in which case the angles to which the barrel shall be directed are transferred to the gun. The operator generates the beforementioned control signal by means of the control member 2 in that he looks through the observation member 3 by means of a sight 7 and by manipulating the member 2 controls said observation member 3 so that it is always directed towards the object.

In FIG. 2 is also shown a device 8, which by means of a further pointer 10 is directed towards the object. The device 8 is by means of a cable 9 in connection with the unit 11 for controlling the observation member 3. The device 8 and the pointer 10 are used for directing the observation member 3 in an initial moment towards an emerging object which is to be followed. This may in many a case be practical, since it is often very difficult for the pointer 1 in the initial moment alone to catch the object by means of the observation member.

FIG. 3 shows an arrangement for carrying out the method according to the invention. The embodiment in FIG. 3 is for simplicity's sake only drawn for control in one plane, for instance the horizontal plane.

A generator 20 is provided with a control member 21 for an operator, which corresponds to the member 2 in FIG. 2. The rest of the members in FIG. 3 are comprised in the recontrol unit 4 in FIG. 2.

The generator 20 is via a resistance 22 connected to an amplifier 23 which in a feedback loop comprises a capacitor 24. Means 22, 23 and 24 form together an integrator, the output 25 of which is in connection with the unit 11 in FIG. 2 via the cable 5 and with one input $b$ of a means 26 provided with two inputs $a$ and $b$ on the output of which a signal is obtained which is the product of the two signals on the inputs. This product is further multiplied by 2. The means 26 may be connected to said amplifier 23 via a change-over switch 27 and a resistor 28. In the second position of the change-over switch the member 26 is connected to operational amplifier 30 via a resistor 29. The output of the operational amplifier 30 is designated 33 and is fed back to the input via capacitor 32.

The generator 20 is further connected to the input of the operational amplifier 30 via a switch 34 and a resistor 35. The operational amplifier 30 may also via a switch 36 be fed back by means of a further capacitor 37.

Further the output 33 of the operational amplifier 30 is connected to the second input *a* of means 26 and to a means 38 for squaring the signal and also for instance via the cable 6 in FIG. 2 to a fire control calculator. The output of the means 38 is connected to the input of the operational amplifier 30 via a switch 39 and a resistor 40.

The output 25 of the integrator 22, 23, 24 is further connected to a means 41 for squaring the signal and further via a switch 42 and a resistor 43 to the input of the operational amplifier 30.

The arrangement shown in FIG. 3 works in two different periods. The first period, designated I, implies that the operator by manipulating the control member of the generator controls the observation member to follow the target. During the first period I the recontrol device in FIG. 3 calculates certain values which are fed to the means operating the observation member. The second period II implies that the recontrol device utilizes the signals coming from the operator in period I to form the control signals which in period II, without the aid of the signals of the operator, direct the observation member to the target.

In period II the operator is used only for fine adjustment of the alignment of the observation member to the target. In FIG. 3 designations for the signals from the generator in period I and II are inserted at the output of the generator 20. In period I is given the angular acceleration $\dot{\omega}_{sI}$, which is the control signal and where index s indicates that in the example mentioned it is only the question of lateral movement, since FIG. 3 only shows devices for controlling in one plane. The correction signal from the operator in period II is designated by the angular acceleration $\Delta\dot{\omega}_s$.

In the first period I all the switches are in the position shown in the figure. When the generator 20 is turned a voltage is generated, which in the system corresponds to the value $\dot{\omega}_{sI}$, which is integrated by the conventional integrator 22, 23, 24 to the value $\omega_s$ which controls the angular velocity of the aligning means in question.

The value $\omega_s$ is also supplied to the means 26, the other supplied value of which is $(\dot{r}/r)_I$ coming from the operational amplifier 30. The output value from the means 26 is $2\omega_s \cdot (\dot{r}/r)$, which is supplied to the operational amplifier 30 via the resistor 29.

Further, this amplifier is supplied with the value $\dot{\omega}_{sI}$. The capacitor 32 which feeds back the amplifier 30 has a low capacitance and the time constant in this integrator will be equal compared with the resistors 29 and 35, whereby the amplification will be high. This coupling of the amplifier 30 now works in such a way that $\dot{\omega}_s + 2\omega_s \cdot (\dot{r}/r) = 0$ (compare the equation (3) above), whereby $\dot{r}/r$ is defined by the supplied values of $\dot{\omega}_s$ and $\omega_s$.

After a suitable lapse of time all the switches in FIG. 3 are switched over to their second position, whereby the arrangement functions in the following manner:

The amplifier 30 is supplied with the values $(\dot{r}/r)^2$ from the means 38 and $\omega_s^2$ with a negative symbol from the means 41 via the resistors 40 and 43. The amplifier 30 is now fed back also by means of the capacitor 37 which has a rather large capacitance. The time constant will be one, whereby the equation (5) indicated before, is realized with $\dot{r}/r$ as output value.

The integrator-coupled amplifier 23 is now supplied with $2\omega_s \cdot \dot{r}/r$, whereby the equation (1) is realized. The signal from the generator 20, $\Delta\dot{\omega}_s$, means in this period the tangential component of the vector acceleration in the scale $1/r$ according to the equation (1). The control now obtains the abovementioned quantities wanted.

Figure 4:
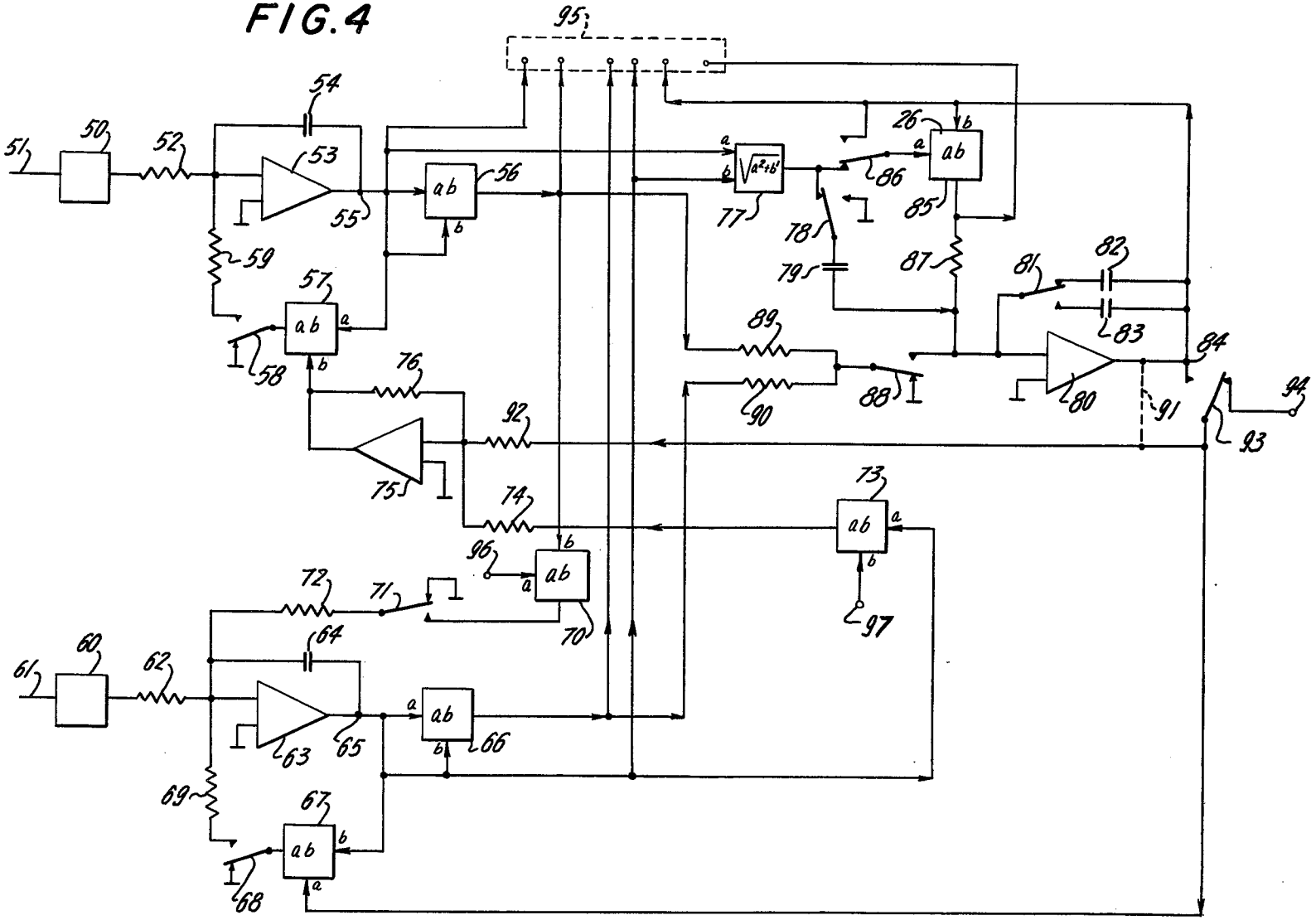

The embodiment in FIG. 4 is an example of how the device in FIG. 3 can be developed to comprise the general case when an object is moving in space. A generator 50 is provided with a control member 51 for an operator and corresponds in FIG. 2, together with a corresponding member 60, 61, to the member 2. The generator 50 is by means of a resistor 52 combined with an amplifier 53 which is fed back by means of a capacitor 54. The means 52, 53 and 54 form together an integrator, the output 55 of which is on one hand in connection, via the cable 5 in FIG. 2, to the unit 11 in FIG. 2 and on the other hand to the one inlet *a* of a means 56 provided with two inputs, a multiplier, at the outlet of which a signal is received which is the product of the two signals on the inlets. Further, the output 55 of the amplifier 53 is connected to a further multiplier 57, which is provided with two inlets and on the outlet of which the product of the input signals occurs. The multiplier 57 is connected via a switch 58 to zero potential or via a resistor 59 to the input of the amplifier 53.

The circuits now enumerated are used for azimuth control. For elevation control serves a part of the device in FIG. 4, which is identically constructed as the one used for azimuth control, and which comprises the circuits 61 - 69. Mutually identical means in the azimuth and elevation circuits have the same final figure of indication.

The output of the circuit 56 is connected to one of the inputs of a multiplier 70. The output of said multiplier is connected to the input of the amplifier 63 via a breaker 71 and a resistor 72. The output of said amplifier 63 is connected to a multiplier 73, provided with two inputs. Said circuit multiplies the signals at the two inputs, and the output of the circuit is, via a resistor 74, connected to an amplifier 75 which is fed back via a resistor 76 and connected to the one input *b* of the multiplier circuit 57. The outputs of the amplifier 53 and 63 are connected to the two inputs of a circuit 77, on the output of which a signal is generated which is the root of the sum of the squares of the input signals. The output of the circuit 77 is, via a switch 78 and a capacitor 79 connected to an amplifier 80 which by means of a switch 81 on one hand, may be fed back by means of a capacitor 82 having a comparatively small capacitance and on the other hand by means of a capacitor 83 having a greater capacitance. The signal at the output 84 of the amplifier 80 is fed into an input *b* on a multiplier circuit 85, the second input of which may be connected via a switch 86 to either the same signal source as the first input *b* or to the circuit 77. The output of the multiplier circuit 85 is connected via a resistor 87 to the input of the amplifier 80.

Also the outputs of the multiplier circuits 56 and 66 may be connected, by means of a switch 88, to the input of the amplifier 80 via resistors 89 and 90. The output 84 of the amplifier 80 may be connected via a connection 91, dash-drawn in the figure, on one hand via a resistor 92 to the input of the amplifier 75 and on the other hand to the one input *a* of the multiplier circuit 67.

In another embodiment said output 84 is instead connected to said amplifier 75 and multiplier circuit 67 via a switch 93. In another position of the switch 93 said circuits are instead connected to an outer signal source 94.

A number of terminals 95 are drawn in the figure and via these terminals the arrangement in the figure is connected to the other members as will be described in the following.

It has been mentioned before that the azimuth angle is designated $\alpha$ and the angular velocity in this direction $\omega_s$. The elevation angle is now designated $\lambda$ and the angular velocity in this direction $\omega_h$. In the embodiment first described the switch 93 in FIG. 4 is assumed to be substituted by the fixed connection 91.

The following control equations will be derived from the argumentations in connection with FIG. 3

$$\dot{H}_\alpha = \frac{\dot{\ }}{\omega_s \cos\lambda} + \left(2\frac{\dot{r}}{r} - \omega_h \tan\lambda\right) \cdot \omega_s \cos\lambda \qquad (6a)$$

$$\dot{H}_\lambda = \dot{\omega}_h + 2\frac{\dot{r}}{r}\omega_h + (\omega_s \cos\lambda)^2 \cdot \tan\lambda \qquad (6b)$$

and in a way corresponding to equation (4)

$$\epsilon_r = \left(\frac{\ddot{r}}{r}\right) + \left(\frac{\dot{r}}{r}\right)^2 - (\omega_s \cos\lambda)^2 - \omega_h^2$$

$$\text{set } \omega = \sqrt{(\omega_2 \cos\lambda)^2 + \omega_h^2}$$

In analogy to equation (3) is obtained:

$$0 = \dot{\omega} + 2\frac{\dot{r}}{r}\omega \qquad (7)$$

The equation (7) determines $\dot{r}/r$ in the same manner as has been described above.

This is one of several ways to form $\dot{r}/r$ during the first period I of the control in the same way as has been described for the case in the plane in connection with FIG. 3.

During the tracking period I all switches are in the position drawn in FIG. 4. The circuits 52, 53, 54 form an integrator as well as the circuits 62, 63 and 64. In point 55 is received a signal representing $\omega_s \cos\lambda$ and in point 65 a signal representing the value $\omega_h$.

The multiplier circuits 56 and 66 give values corresponding to $(\omega_s \cos\lambda)^2$ and $\omega_h^2$, respectively. The multiplier circuit 57 is supplied with the values $(\omega_s \cos\lambda)$ from the amplifier 53 and $(\dot{r}/r) - \omega_h \tan\lambda$ from the amplifier 75 and therefore the output value corresponds to the product of these signals. In the same way the output value from the multiplier circuit 67 corresponds to the value $(\dot{r}/r) \cdot \omega_h$. The output signals from the amplifiers 53 and 63 are fed also to the circuit 77, on the output of which appears the square root of the sum of the square of the input signals. Such a circuit is described in the French patent 2,112,040. On the output of the circuit 77 is to be found the value of $$\omega = \sqrt{(\omega_s \cos\lambda)^2 + \omega_h^2}\,.$$

in the first period I this value is supplied to the multiplier 85, the second input signal of which is $\dot{r}/r$, which is the result value from the amplifier 80. The output value of the multiplier is thus $(\dot{r}/r) \cdot \omega$. The value $\omega$ is further derived in the capacitor 79 to $\dot{\omega}$, whereby the equation (7) is realized by the choice of the right constants.

In the tracking period II all switches are switched over to take a position contrary to that shown in the figure. The amplifier 80 realizes the equation (6*c*) where $\omega_s^2 \cos^2\lambda$ and $\omega_h^2$, that is the two last terms of the equation (6*c*) are added by means of the resistors 89 and 90 and the output value still represents the value $\dot{r}/r$. The value $(\dot{r}/r)^2$ is created in the multiplier 85 and is added to the amplifier 80 with the resistor 87.

By means of the switches 58, 68 and 71 the amplifiers 53 and 63 are supplied with values so that the equations (6*a*) and (6*b*), respectively, may be realized, whereby the control aid required is obtained.

On the terminal 95 in FIG. 4 a number of signals are received which are used for controlling the observation member 3 in FIG. 2 and perhaps a fire control calculator or the like. The angular velocity of the system is used for controlling the observation member and is supplied to a calculator, whereas the relative distance speed is only supplied to the calculator. Further the squares of said angular velocities and said relative distance speed are supplied to the fire control calculator of a gun to be used in the fire control calculations. This will be described in more detail further on in the specification.

A somewhat modified embodiment consists in that the connection 91 is replaced by a switch 93, as shown in FIG. 4. This modified embodiment may be used in case the object moves towards the observation member, which is always the case in period I. Hereby $\dot{r}$ is negative and therefore it is often suitable even during the tracking period I to use the equations (6*a*) and (6*b*) but with an estimated (fixed) value of $\dot{r}/r$ set for instance to about $-0.1$, which in that case is supplied to a connection 94. The switches 58, 68 and 71 may therefore be deleted or always be in the opposite position to that which is drawn in the figure.

Finally there is to be observed that the values $(\omega_s \cos\lambda)^2 \cdot \tan\lambda$ and $\omega_h \tan\lambda$ may be supplied even during the period I whether terms containing the factor $\dot{r}/r$ is used or not. Hereby the values of $\tan\lambda$ are supplied to the connections 96 and 97 on the members 70 and 73.

The data i.e. $\omega$ (two components) and $\dot{r}/r$ measured in the two periods I and II of the control, before and after the switch over to re-control may be used in a fire control calculator for the control of a weapon connected to the device. In the situation when the target tracking device lacks continuous information of the distance to the target, distance initial lead calculation has not been possible in the direction to the target. Nor has it been possible to determine the right time for the projectile to reach the target, i.e. to estimate the extrapolation time.

In systems having only angular velocity measuring one has been submitted to applicative systems with as a rule two estimated input quantities, target speed F and smallest passage distance $r_{min}$.

Even if these attempts in certain cases are successful, it is necessary that both are constant. A summing up of the limitations, however, involves that the result does not allow first-class precision of the fire control. Here the further possibilities will be shown which exist when the relative distance velocity having high precision is available as described before.

For correct calculation of all fire control data required, it is necessary to know the instantaneous position of the target and its velocity vector. If, on the other hand, direction, relative distance velocity $(\dot{r}/r)$ $(t)$ and angular velocities and one single measure of the distance at a certain occasion $r(t_o)$ are known, for instance by single measuring by means of a laser distance measuring instrument, the continuous distance $r_{ut}$ may be estimated in the following way:

$$r_{ut} = r(t_o) + \int_o^t \left( \frac{\dot{r}}{r}(t) \cdot r_{ut} \right) dt \tag{8}$$

whereby all data for complete fire control estimation are available.

In many cases the value of the approximate target speed F can be estimated, which gives a basis for determining the initial distance required $(r(t_o)$ or if so is desired several successive distances.

$$F = r \sqrt{(\omega_s \cos \lambda)^2 + \omega_h^2 + \left(\frac{\dot{r}}{r}\right)^2} \tag{9}$$

or $$r = F_{estimated} \sqrt{(\omega_s \cos \lambda)^2 + \omega_h^2 + \left(\frac{\dot{r}}{r}\right)^2} \tag{10}$$

What is claimed is:

1. A method for controlling apparatus to track an object moving relative thereto, wherein a member is pointed towards said object during a first time interval and a drive signal is applied to a driven member at the end of said time interval to keep said driven member pointed towards said object; said method comprising the steps of:

generating an orientation signal which is a time function of the orientation of said member;

operating on said orientation signal to derive a further signal indicative of the movement of said object; and combining said orientation signal and said further signal at the end of said first time interval to provide said drive signal.

2. The method as defined in claim 1 in which said orientation signal represents the first derivative of the angular velocity of said member.

3. The method as defined in claim 1 in which said further signal is a time function of the distance of said object from said member.

4. The method as defined in claim 3 in which said orientation signal represents the first derivative of the angular velocity of said member.

5. The method as defined in claim 4 in which said member is said driven member.

6. In apparatus for tracking an object moving relative thereto, wherein a member is pointed towards said object during a first time interval and a driven member is controlled at the end of said first interval, the improvement comprising means for generating a drive signal for application to said driven member to assist in keeping said driven member pointed towards said object including:

means for generating an orientation signal which is a time function of the orientation of said member;

means operating on said orientation signal for deriving a further signal indicative of the movement of said object; and means for combining said orientation signal and said further signal at the end of said first time interval to provide said drive signal.

7. The improvement defined in claim 6 in which said orientation signal represents the first derivative of the angular velocity of said member.

8. The improvement defined in claim 6 in which said further signal is a time function of the distance of said object from said member.

9. The improvement defined in claim 8 in which said orientation signal represents the first derivative of the angular velocity of said member.

10. The improvement defined in claim 9 in which said member is said driven member.

* * * * *

UNITED STATES PATENT OFFICE

CERTIFICATE OF CORRECTION

Patent No. 4,017,716 Dated April 12, 1977

Inventor(s) CARL TORBERN TEILING Page 1 of 2

It is certified that error appears in the above-identified patent and that said Letters Patent are hereby corrected as shown below:

Column 2, Line 37, the equation shown should read: -- $a_r = \ddot{r} - r\omega_s^2$ -- .

Column 2, Line 47, delete "$\omega_s$" and insert therefor: -- $\dot{\omega}_s$ -- .

Column 2, Line 53, the equation shown should read: -- $r\dot{\omega}_s + 2\dot{r}\omega_s = \dot{H}_\alpha . r$ -- .

Column 2, Line 55, delete "$\dot{H}\alpha$" and insert therefor: -- $H_\alpha$ -- .

Column 2, Line 61, the equation shown should read: -- $\dot{H}_\alpha = \dot{\omega}_s + 2\omega_s(\dot{r}/r)$ Column 3, Line 8, the equation shown should read: -- $\dot{H}_\alpha = \dot{\omega}_s$ Column 3, Line 22, the equation shown should read: -- $a_r = \ddot{r} - r\omega_s^2$ Column 3, Line 32, the equation shown should read: -- $a_r = r \cdot \varepsilon_r$ -- .

Column 3, Line 43, delete "$E_r$=O" and insert therefor: -- $\varepsilon_r = 0$ -- .

Column 3, Line 53, delete "$(\dot{r}/r)(0)$" and insert therefor: -- $\frac{\dot{r}}{r}(0)$ -- .

Column 3, Lines 57 and 58, delete"$(\dot{r}/r)(t)$" and insert therefor: -- $\frac{\dot{r}}{r}(t)$ -- .

UNITED STATES PATENT OFFICE

CERTIFICATE OF CORRECTION

Patent No. 4,017,716 Dated April 12, 1977

Inventor(s) CARL TORBERN TEILING

It is certified that error appears in the above-identified patent and that said Letters Patent are hereby corrected as shown below:

Column 9, Line 1, delete "$(\dot{r}/r)(t)$" and insert therefor:

-- $\frac{\dot{r}}{r}(t)$ -- .

Column 9, Line 26, the equation shown should read:

-- $$r = F_{estimated} \cdot \frac{1}{\sqrt{(\omega_s \cos\lambda)^2 + \omega_h^2 + (\frac{\dot{r}}{r})^2}}$$

Signed and Sealed this thirtieth Day of August 1977

[SEAL]

Attest:

RUTH C. MASON
Attesting Officer

C. MARSHALL DANN
Commissioner of Patents and Trademarks